United States Patent [19]

Hunt, III

[11] 4,450,910

[45] May 29, 1984

[54] THERMAL RECOVERY OF VISCOUS OIL FROM A DIPPING RESERVOIR

[75] Inventor: William C. Hunt, III, Farmers Branch, Tex.

[73] Assignee: Mobil Oil Corporation, New York, N.Y.

[21] Appl. No.: 392,825

[22] Filed: Jun. 28, 1982

[51] Int. Cl.[3] ..... E21B 43/24

[52] U.S. Cl. ..... 166/261; 166/263; 166/251; 166/256

[58] Field of Search ..... 166/261, 263, 256, 251

[56] References Cited

U.S. PATENT DOCUMENTS

| | | | |
|---|---|---|---|
| Re. 24,873 | 9/1960 | Lindquer, Jr. | 166/268 |
| 3,072,185 | 1/1963 | Bond et al. | 166/261 |
| 3,208,519 | 9/1965 | Moore | 166/261 |
| 3,842,908 | 10/1974 | Thomas et al. | 166/256 |
| 3,964,545 | 6/1976 | Speller, Jr. | 166/256 |

FOREIGN PATENT DOCUMENTS

| | | | |
|---|---|---|---|
| 896338 | 3/1972 | Canada | 166/263 |

*Primary Examiner*—Stephen J. Novosad
*Assistant Examiner*—Mark J. Del Signore
*Attorney, Agent, or Firm*—A. J. McKillop; M. G. Gilman; L. O. Miller

[57] ABSTRACT

Disclosed is a method for recovering oil from a dipping subterranean, viscous oil-containing reservoir having an underlying body of water. An in situ combustion operation is initiated using an oxidizing gas injected through an injection well in fluid communication with the lower portion of the reservoir near the oil/water interface. Fluids including oil and effluent gas are recovered from the reservoir through a production well in fluid communication with a shallower portion of the reservoir. After a predetermined amount of time, injection of the oxidizing gas is terminated and the reservoir is allowed to undergo a soaking period for a predetermined amount of time. Thereafter, a water drive is initiated by injecting water into the injection well and fluids including oil are recovered from the reservoir through the production well.

10 Claims, 1 Drawing Figure

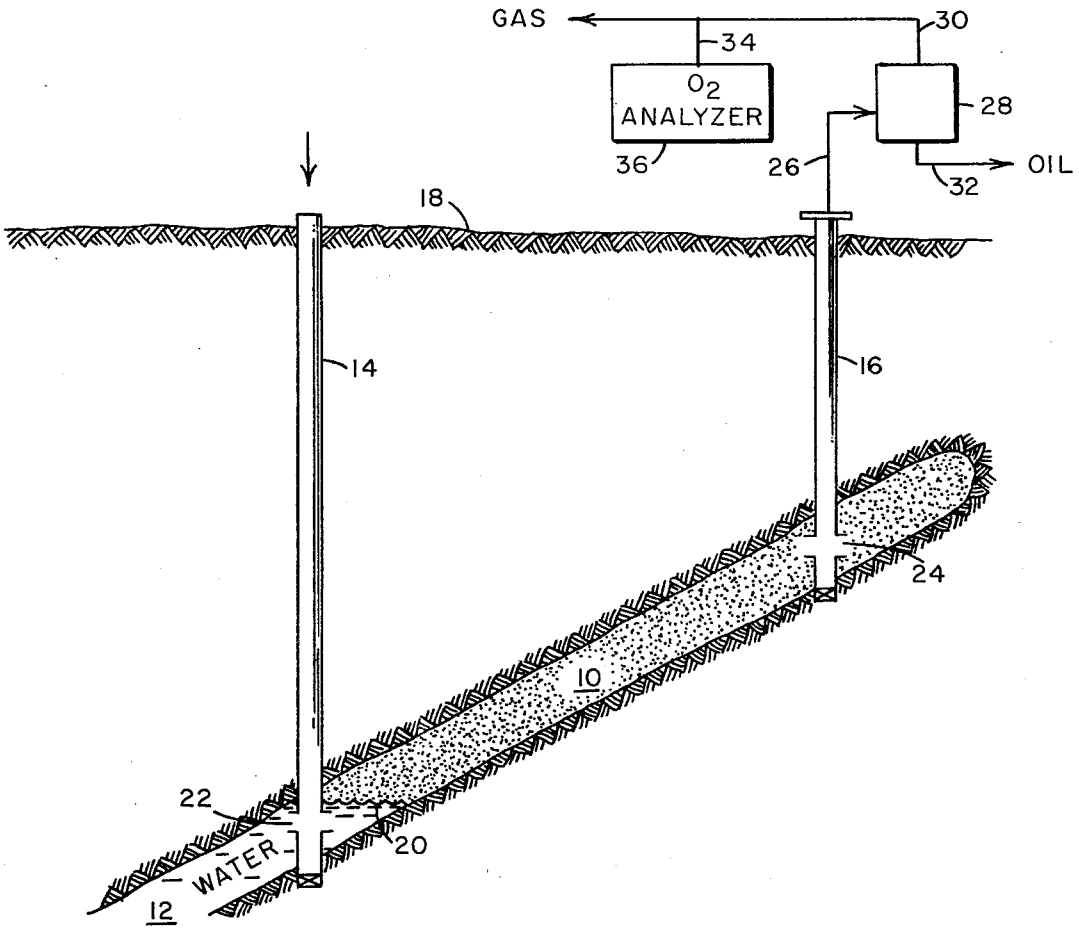
GAS
30
34
$O_2$ ANALYZER
36
28
OIL
32
26
18
16
14
24
10
20
22
WATER
12

THERMAL RECOVERY OF VISCOUS OIL FROM A DIPPING RESERVOIR

FIELD AND BACKGROUND OF THE INVENTION

1. Field of the Invention

This invention relates to a thermal oil recovery method for recovering viscous oil from a dripping oil reservoir. More particularly, the invention relates to a method for recovering oil from a dipping subterranean oil reservoir overlying a body of water by first initiating an in situ combustion operation near the oil/water interface followed by a soak period and followed by a water drive.

2. Background of the Invention

In the recovery of oil from tilted oil-bearing reservoirs, it is known to inject a fluid which is miscible with the oil into the upper portion of the reservoir and drive the fluid down through the reservoir so as to displace the oil toward a production well in the lower portion of the reservoir where the oils is recovered. This type of process is disclosed in U.S. Pat. No. 3,223,157 to Lacey et al. and U.S. Pat. No. 3,312,278 to Warden. In this type process, the miscible fluid does not tend to finger and dissolve into the oil because of the gravity effect tending to "float" the fluid above the reservoir oil.

As disclosed in U.S. Pat. No. 3,223,157 to Lacey et al. discussed above, for economic reasons the solvent is normally injected as a slug followed by another fluid such as a gas or an aqueous fluid or a combination of water and gas to drive the solvent slug and the oil through the reservoir.

In a pending application to J. M. McMillen, Ser. No. 253,120, filed Apr. 10, 1981, co-assignee, there is disclosed a method for recovering oil from a titled oil-bearing reservoir having a water zone in fluid communication with and directly below an oil zone wherein a large amount of solvent is injected along the water-oil interface so that a part of the solvent fingers into the oil, lowering its viscosity and making the oil more mobile for production. The remainder of the solvent is driven through the reservoir by a water flood wherein the rate is controlled slow enough that gravity minimizes fingering of the water into the oil layer, sweeping oil toward the production well. Solvent stimulation of the producing well provides additional incremental recovery and encourages the flooded oil toward the production well.

SUMMARY

This invention relates to a method for recovering oil from a subterranean, viscous oil-containing reservoir having a dip and having a water zone in fluid communication with and directly below the oil-containing reservoir to form an oil/water interface, comprising providing an injection well from the earth's surface in fluid communication with the oil-containing reservoir near the oil/water interface, providing a production well from the earth's surface in fluid communication with the oil-containing reservoir at a shallower depth, initiating an in situ combustion operation in the oil-containing reservoir by injecting an oxidizing gas into the injection well, recovering fluids including oil and an effluent gas from the reservoir through the production well, continuing injection of the oxidizing gas into the reservior through the injection well for a predetermined amount of time, thereafter terminating injection of the oxidizing gas and shutting-in the injection well and the production well to permit the reservoir to undergo a soak period for a predetermined amout of time, thereafter injecting water into the reservoir through the injection well and recovering fluids including oil from reservoir through the production well. Injection of oxidizing gas may be terminated once the oxygen concentration of the effluent gas recovered from the production well reaches a predetermined level, preferably 21 vol.%. Also, prior to the soak period, production of fluids may be continued until the fluids recovered from the production well contain essentially no effluent gas.

BRIEF DESCRIPTION OF THE DRAWING

The drawing schematically shows a dipping subterranean, viscous oil-containing reservoir with an underlying body of water penetrated by an injection well and a production well for carrying out the process of the present invention.

DESCRIPTION OF THE PREFERRED EMBODIMENT

Referring to the drawing, there is shown a dipping subterranean, viscous oil-containing reservior 10 overlying a body of water 12 which is continuous along the lower portion of the oil-containing reservoir. A dipping reservoir is a reservoir having an angle between the reservoir and the horizontal plane of at least 5° and preferably more than 15°. At least two wells 14 and 16 are drilled from the earth's surface penetrating the steeply-dipping reservoir 10. Well 14 which is to serve as an injection well, is drilled into the lower portion of the reservoir 10 and fluid communication is established between the reservoir and the well near the oil water interface 20 by means of perforations 22. Well 16 serves as a production well and the lower end is completed by perforations 24 to establish fluid communication between the well and the reservoir 10 at a shallower depth in the reservoir than injection well 14. In the case of a single production well 16 as shown in the drawing, the production well is in fluid communication with the most shallow portion of the oil-containing reservoir 10. However, one or more intermediate wells may be used sequentially as production wells for the reservoir oil.

In the first step, an in situ combustion operation is initiated in the oil-containing reservoir 10 near the oil/water interface 20 by injecting an oxidizing gas, such as air, oxygen-enriched air, and oxygen or other gases capable of sustaining combustion of the resevoir hydrocarbons into injection well 14. After combustion has been initiated by suitable means, injection of the oxidizing gas is continued to move the combustion front upward toward production well 16 and fluids including oil and effluent gas are recovered from the reservoir 10 via production well 16 through line 26. The heat generated by the combustion front creates a visbreaking zone containing visbroken oil reduced in viscosity in advance of the combustion front that moves generally upwardly away from the injection well 14 in the direction of the production well 16. The visbroken oil acts as a solvent on the viscous oil ahead of the visbroken zone reducing its viscosity and as the combustion front progresses through the reservoir 10, mobilized reservoir oil is displaced toward the production well 16 for recovery. The recovered fluids from production well 16 are delivered to a separator 28 via line 26 where separation is made between the oil and gases. Effluent gas which includes components of carbon dioxide and oxygen and additional gases are withdrawn through from the separator 28 through line 30 and oil is withdrawn through line 32. A portion of the effluent gas is withdrawn through branch line 34 and the concentration of oxygen in the gas is periodically determined by means of a gas analyzer 36. The effluent gas recovered through line 30 may economically be recovered and sold as long as the heating value of this gs is sufficiently high.

The in situ combustion operation is continued using oxidizing gas fluids including oil and effluent gas are recovered from the reservoir 10 for a predetermined period of time preferably until the production well 16 has had a significant thermal response, or until the oxygen content of the effluent gas in line 30 reaches a predetermined value, preferably 21 vol. %. Thereafter, injection of the oxidizing gas is terminated and both wells 14 and 16 are shut-in for a predetermined period of time to allow the reservoir 10 to undergo a soak period. During the soak period, the reservoir 10 undergoes further visbreaking and solvent fingering. The visbroken oil having a viscosity and density less than the reservoir oil fingers upwardly through the reservoir 10 by gravity dissolving in the oil and reducing its viscosity. In addition, the soak period allows the heat generated by the previous in situ combustion operation to slowly dissipate into the reservoir oil to induce further visbreaking of reservoir oil. The length of the soak period will vary depending upon the characteristics of the reservoir, particularly the viscosity of the reservoir oil. Once the soak period is over both wells 14 and 16 are re-opened and water is injected into the reservoir via the injection well 14 for the purpose of scavenging heat from the reservoir 10 and to drive oil toward the production well 16 for recovery. Water injection is continued until the oil/water ratio of the fluids recovered from the reservoir via production well 16 is unfavorable. The bottom water drive allows efficient sweep of the reservoir 10.

In a slightly different embodiment of the present invention, when injection of oxidizing gas is terminated, production of fluids including oil and effluent gas from production well 16 is continued until the fluids recovered contain essentially no effluent gas. Thereafter, both wells 14 and 16 are shut-in to allow the reservoir to undergo a soak period for a predetermined amount of time followed by a water drive as previously described.

For the purpose of simplicity in describing the invention, reference has been made to only one injection well and one production well. However, it will be recognized that in practical application of the invention, a plurality of injection wells along the water-oil interface 20 line of the reservoir 10 and a plurality of production wells may be used and in most cases will be utilized.

While the embodiment of the invention described above and illustrated in the drawings constitute the best mode contemplated for carrying out the invention, it will be apparent that various modifications may be practiced without departing from the spirit of the invention. It is my intention and desire that my invention be limited only by those restrictions or limitations as are contained in the claims appended immediately hereinafter below.

What is claimed is:

1. A method for recovering oil from a subterranean, viscous oil-containing reservoir having a dip and having a water zone in fluid communication with and directly below the oil-containing reservoir to form an oil/water interface, said method comprising the steps of:

(a) providing an injection well from the earth's surface in fluid communication with the oil-containing reservoir near the oil/water interface;

(b) providing a production well from the surface in fluid communication with the oil-containing reservoir at a shallower depth;

(c) initiating an in situ combustion operation in the oil-containing reservoir near the oil/water interface by injecting an oxidizing gas into the injection well;

(d) recovering fluids including oil and an effluent gas from the reservoir through the production well;

(e) continuing injection of the oxidizing gas into the reservoir through the injection well for a predetermined amount of time;

(f) terminating injection of the oxidizing gas and continuing to recover fluids including oil and effluent gas from the reservoir through the production well until the fluids recovered contain essentially no effluent gas;

(g) shutting-in the injection well and the production well to permit the reservoir to undergo a soak period for a predetermined amount of time; and (h) injecting water into the reservoir through the injection well and recovering fluids including oil from the reservoir through the production well.

2. The method as defined in claim 1 wherein the oxidizing gas is essentially pure oxygen.

3. The method as defined in claim 1 wherein the oxidizing gas is air.

4. The method as defined in claim 1 wherein the oxidizing gas is oxygen-enriched air.

5. The method as defined in claim 1 wherein injection of water during step (g) is continued and fluids including oil are recovered from the reservoir through the production well until the oil/water ratio is unfavorable.

6. A method for recovering oil from a subterranean, viscous oil-containing reservoir having a dip and having a water zone in fluid communication with and directly below the oil-containing reservoir to form an oil/water interface, said method comprising the steps of:

(a) providing an injection well from the earth's surface in fluid communication with the oil-containing reservoir near the oil/water interface;

(b) providing a production well from the surface in fluid communication with the oil-containing reservoir at a shallower depth;

(c) initiating an in situ combustion operation in the oil-containing reservoir near the oil/water interface by injecting an oxidizing gas into the injection well;

(d) recovering fluids including oil and an effluent gas from the reservoir through the production well;

(e) continuing injection of the oxidizing gas into the reservoir through the injection well for a predetermined amount of time;

(f) terminating injection of the oxidizing gas when the oxygen concentration of the effluent gas reaches the level of 21 volume percent and shutting-in the injection well and the production well to permit the reservoir to undergo a soak period for a predetermined amount of time; and (g) injecting water into the reservoir through the injection well and recovering fluids including oil from the reservoir through the production well.

7. The method as defined in claim 6 wherein the oxidizing gas is essentially pure oxygen.

8. The method as defined in claim 6 wherein the oxidizing gas is air.

9. The method as defined in claim 6 wherein the oxidizing gas is oxygen-enriched air.

10. The method as defined in claim 6 wherein injection of water during step (g) is continued and fluids including oil are recovered from the reservoir through the production well until the oil/water ratio is unfavorable.

* * * * *